US008180235B2

(12) United States Patent
Shirafuji

(10) Patent No.: US 8,180,235 B2
(45) Date of Patent: May 15, 2012

(54) IMAGE FORMING APPARATUS

(75) Inventor: Yasuhito Shirafuji, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 453 days.

(21) Appl. No.: 12/576,083

(22) Filed: Oct. 8, 2009

(65) Prior Publication Data

US 2010/0092198 A1 Apr. 15, 2010

(30) Foreign Application Priority Data

Oct. 10, 2008 (JP) ..... 2008-264344

(51) Int. Cl.

| | |
|---|---|
| ***G03G 15/00*** | (2006.01) |
| ***G03G 15/01*** | (2006.01) |
| ***G03G 15/02*** | (2006.01) |
| ***G03G 21/00*** | (2006.01) |

(52) U.S. Cl. ..... 399/49; 399/31; 399/165; 399/176; 399/301; 399/302; 399/128

(58) Field of Classification Search ..... 399/49, 399/72

See application file for complete search history.

(56) References Cited

U.S. PATENT DOCUMENTS

| | | | | |
|---|---|---|---|---|
| 2006/0159494 | A1* | 7/2006 | Hirai et al. | 399/303 |
| 2006/0222387 | A1* | 10/2006 | Burry et al. | 399/49 |

FOREIGN PATENT DOCUMENTS

| | | | |
|---|---|---|---|
| JP | 09-48533 | A | 2/1997 |
| JP | 2004-252300 | A | 9/2004 |
| JP | 2010054987 | A * | 3/2010 |

* cited by examiner

*Primary Examiner* — David Gray
*Assistant Examiner* — David Bolduc
(74) *Attorney, Agent, or Firm* — CANON USA, Inc., IP Division

(57) ABSTRACT

An image forming apparatus has a control unit that outputs the state of a belt member on the basis of the result of detection by a toner image detecting unit, of a toner image formed by a developing unit in a charged region of an image bearing member charged by applying a voltage to a transfer unit without charging the image bearing member using a charging unit.

7 Claims, 9 Drawing Sheets

IMAGE FORMING APPARATUS

BACKGROUND OF THE INVENTION

1. Field of the Invention

The present invention relates to an image forming apparatus such as a printer, a copying machine, or a facsimile machine, and more specifically, it relates to an image forming apparatus that transfers a toner image formed on an image bearing member onto a recording material using a transfer belt or an intermediate transfer belt.

2. Description of the Related Art

An image forming apparatus that uses an electrophotographic method in the process of forming an image uses, as a belt member, a transfer belt that bears and conveys a recording material, or an intermediate transfer belt that bears a toner image transferred from a photosensitive member. In such a configuration, the transfer belt or the intermediate transfer belt is looped over a plurality of rollers, and the displacement of the belt is controlled (Japanese Patent Laid-Open No. 09-48533). To control the displacement of the belt member, a sensor is provided that detects the position and speed of the belt member. When the belt member is displaced or meanders, the inclination of the shaft of at least one of the rollers is changed to correct the displacement. Alternatively, a displacement limiting member is provided along the edge of the belt member to limit the displacement of the belt member.

In each case, the belt member is stressed in a direction perpendicular to the rotating direction, and a ridge or groove (hereinafter referred to as tension line) can be generated in the belt member along the conveying direction (Japanese Patent Laid-Open No. 2004-252300).

If a tension line is generated, a gap is generated between the image bearing member and the belt in the primary transfer section. Therefore, when a transfer bias is applied, due to this gap, there is a difference in resistance of the primary transfer section between the tension line and other regions. When there is a difference in resistance, there is a difference in transfer current. This causes defective transfer such as a weak current white spot or an excess current white spot in the tension line. As a result, defective image formation (a vertical line) attributed to the tension line is caused.

In a normal image forming apparatus, causes of a vertical line include, in addition to a tension line, contamination of a primary charging wire or a charging roller, contamination of a developing roller, and defective cleaning.

A vertical line due to defective cleaning is relatively easily identified because it is generated in the sub-scanning direction regardless of electrostatic latent image, that is, regardless of whether image part or non-image part.

However, causes of a vertical line include not only defective cleaning but also a tension line of a transfer belt or an intermediate transfer belt, contamination of a primary charging wire or a charging roller, and contamination of a developing roller. When a vertical line image is generated, it is not easy to identify which component causes the vertical line just by viewing the image.

A tension line generated in an intermediate transfer belt or a transfer belt causes a vertical line image even if the tension line is about 2 μm in depth and about 2 mm in width. Therefore, it is difficult to visually identify the location of a tension line. The same can be said to some extent for contamination of a primary charging wire or a charging roller.

The time of occurrence of damage or contamination of each component that causes a vertical line depends on use environment. The damage or contamination can occur by chance. The time of occurrence of the damage or contamination cannot be predicted from the life of each component.

Replacing all components including normal components when defective image formation occurs increases the cost.

To prevent the increase in cost, components can be replaced one by one. Every time a component is replaced, a test is conducted to determine whether defective image formation still occurs. Thus, the problem component can be identified.

However, unlike a charger and a developing unit, a belt member cannot be easily replaced. The above-described method includes many processes and takes a lot of time.

It is desirable to determine whether a tension line is generated in a belt member by a simple method.

SUMMARY OF THE INVENTION

The present invention provides an image forming apparatus that can easily determine whether a belt member is damaged.

In an aspect of the present invention, an image forming apparatus includes an image bearing member, a charging unit, a developing unit, a toner image detecting unit, a belt member, a transfer member, and a control unit. The charging unit charges the image bearing member. The developing unit develops an electrostatic latent image formed by exposing a surface charged by the charging unit and forms a toner image. The toner image detecting unit detects the toner image on the image bearing member. The belt member is in contact with the image bearing member. The transfer member transfers the toner image on the image bearing member onto the belt member or onto a recording material on the belt member. The control unit is capable of outputting the state of the belt member on the basis of the result of detection by the toner image detecting unit, of a toner image formed by charging the image bearing member by applying a voltage to the transfer member, and developing a region charged by the transfer member using the developing unit.

Further features of the present invention will become apparent from the following description of exemplary embodiments with reference to the attached drawings.

DESCRIPTION OF THE EMBODIMENTS

The embodiments of the present invention will now be described with reference to the drawings.

First Embodiment

In this embodiment, a description will be given of an image forming apparatus that can easily determine whether a vertical line image generated on paper is attributed to a tension line generated in an intermediate transfer belt.

(1) Apparatus Configuration of This Embodiment

Figure 1:
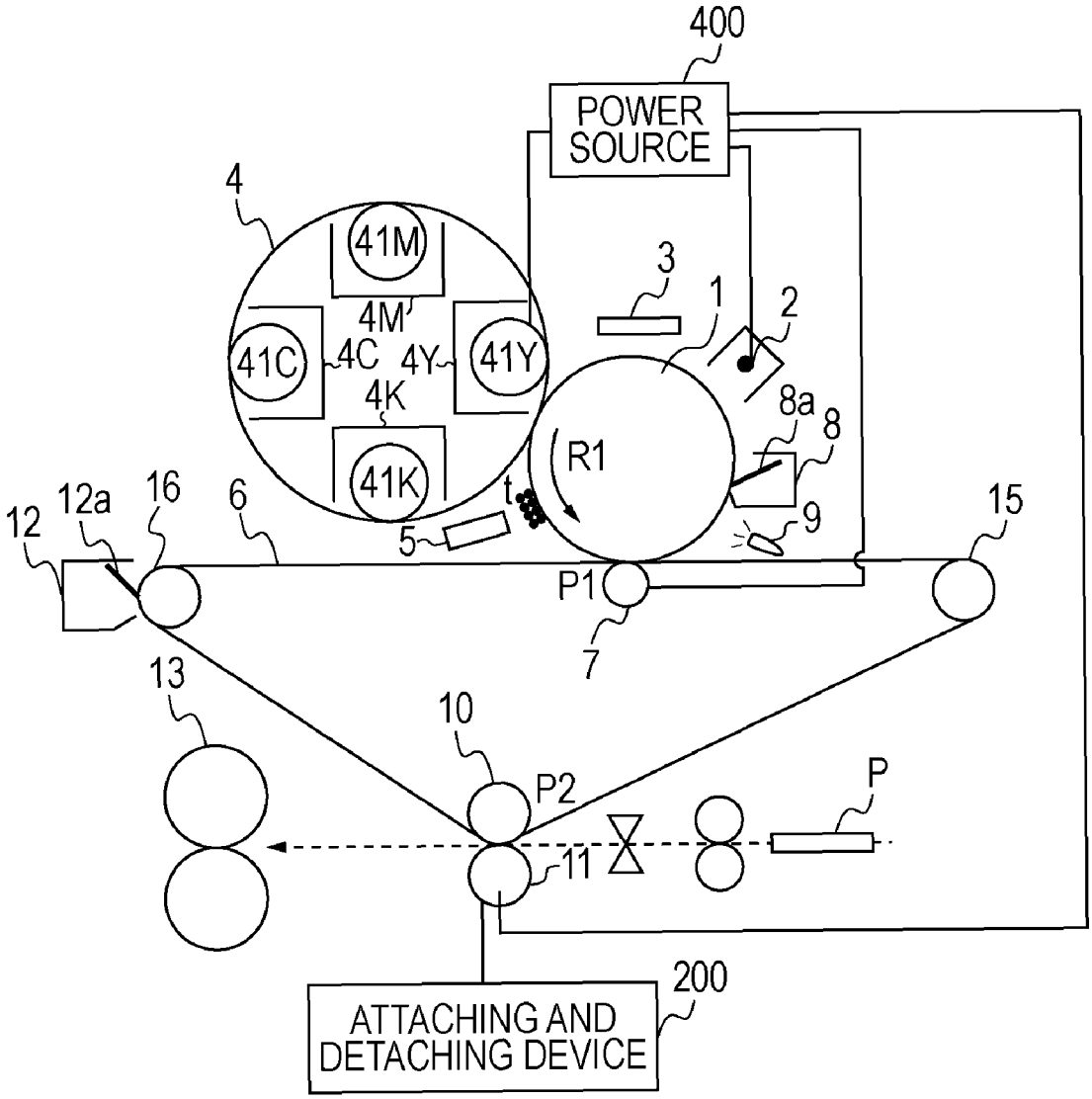
FIG. 1 is a schematic view of an image forming apparatus in a first embodiment.

An embodiment of an image forming apparatus according to the present invention will be described with reference to FIG. 1. FIG. 1 is a side schematic view showing an example configuration of an image forming apparatus according to a first embodiment.

The image forming apparatus has a photosensitive drum 1 serving as an image bearing member.

The photosensitive drum 1 is an amorphous silicon drum having a positive charging polarity and a diameter of 84 mm. The photosensitive drum 1 is rotated by a drive motor (not shown) in the direction of arrow R1 at an image forming speed of 300 mm/s.

Around the photosensitive drum 1, along its rotating direction, a primary charger 2, an exposure unit 3, a developing section 4, a density detecting sensor 5, and an intermediate transfer belt 6, a primary transfer roller 7, and a cleaning unit 8 are arranged substantially in this order.

The primary charger 2, which serves as a charging member, is a corona charger.

The primary charger 2 is disposed so as to face the surface of the photosensitive drum 1. A power source 400 applies a bias to the primary charger 2. In this embodiment, during image formation, the surface of the photosensitive drum 1 is uniformly charged to about +500 V.

The exposure unit 3 is a laser scanner. The exposure unit 3 emits laser light on the basis of image information. The charge of the exposed part is removed, and an electrostatic latent image is formed.

The developing section 4 is disposed downstream of the exposure unit 3 and upstream of the primary transfer roller 7. The developing section 4 includes developing units 4Y, 4M, 4C, and 4K corresponding to yellow (Y), magenta (M), cyan (C), and black (K), respectively.

Each developing unit contains two-component developer and has an opening facing the photosensitive drum 1. In the opening, a developing sleeve (41Y, 41M, 41C, 41K) is rotatably placed. In each developing sleeve is a magnet roller that makes the developing sleeve bear developer. Whereas the developing sleeve rotates, the magnet roller is fixed.

The developer (carrier) forms a magnetic brush due to the magnetic force of the developing main pole located in the developing region of the magnet roller. This magnetic brush rubs the surface of the photosensitive drum 1. The power source 400 applies a developing bias to the developing sleeve. Toner attached to the carrier develops the electrostatic latent image. Thus, a toner image is formed on the photosensitive drum 1. The polarity of toner is negative.

In this embodiment, a developing bias having an AC component of 1.2 kVpp (3 kHz) and a DC component variable within a range of +100 to 450 V is applied to the developing sleeves 41, and thereby development is performed. During normal image formation, the DC component is set to +250 V.

Below the photosensitive drum 1, the intermediate transfer belt 6 is stretched, which serves as a belt member. This intermediate transfer belt 6 is supported by a driving roller 16, a tension roller 15, and a backup roller 10. This intermediate transfer belt 6 is in contact with the photosensitive drum 1 and moves at a speed of 300 mm/s, the same speed as the photosensitive drum 1.

The intermediate transfer belt 6 is formed of a resin such as polyimide or polycarbonate containing an appropriate amount of antistatic agent such as carbon black so that the volume resistivity is $1\times10^{6}$ to $10^{10}\Omega\cdot$cm. The thickness of the intermediate transfer belt 6 is about 0.1 mm.

In the path of the intermediate transfer belt 6 are a primary transfer position P1 and a secondary transfer position P2.

At the primary transfer position P1, the intermediate transfer belt 6 is passed between the photosensitive drum 1 and the primary transfer roller 7.

The primary transfer roller 7, which serves as a primary transfer member, includes a stainless-steel shaft 8 mm in diameter and a conductive urethane sponge layer 4 mm in thickness. The length of the sponge portion is 300 mm. The resistance value is obtained from the relationship of current measured when the shaft is grounded under a load of 500 gram-weight, the transfer roller 7 is rotated at a peripheral speed of 300 mm/s, and a voltage of 1500 V is applied to the surface of the transfer roller. The value was about $1\times10^{7}\Omega$ (23° C. 50% RH).

Both ends of the primary transfer roller 7 are pressed against the surface of the photosensitive drum 1 by pressing members such as springs. The rotation of the photosensitive drum 1 in the direction of arrow R1 rotates the primary transfer roller 7.

In this embodiment, the primary transfer section uses constant current control.

During image formation, the power source 400 applies a desired voltage to the primary transfer roller 7 so that a transfer current of 70 μA can be secured. Thus, a transfer charge determined from the surface potential of the primary transfer roller 7 is charged, and the toner image t on the photosensitive drum 1 is transferred to the surface of the intermediate transfer belt 6.

After primary transfer, the cleaning unit 8 removes adhering matter, such as residual toner, from the photosensitive drum 1.

The cleaning unit 8 includes a cleaner blade 8*a*. The cleaner blade 8*a* comes into contact with the photosensitive drum 1 at a predetermined angle and a predetermined pressure, and recovers toner and so forth remaining on the surface of the photosensitive drum 1.

In this embodiment, to reduce the surface potential of the photosensitive drum 1 as close to 0 V as possible after primary transfer, a pre-exposure unit 9 is provided.

By applying a positive bias in the primary transfer section, the surface of the photosensitive drum 1 is charged positively. The surface potential of the photosensitive drum 1 is determined by the amount of primary transfer current flowing into the place. Therefore, in the case of an uneven image, the photosensitive drum potential after primary transfer differs between image part and non-image part.

If, after that, an electrostatic latent image is formed in the primary charging section and the exposure section, the unevenness in surface potential of the photosensitive drum 1 formed in the primary transfer section is developed as an image. To prevent this, after primary transfer, the surface potential of the photosensitive drum 1 is removed using the pre-exposure unit 9.

At the secondary transfer position P2, a secondary transfer outer roller 11 serving as a secondary transfer member 11 is disposed opposite the backup roller 10. Between the secondary transfer outer roller 11 and the backup roller 10, the intermediate transfer belt 6 is passed. An attaching and detaching device 200 for attaching and detaching the secondary transfer outer roller 11 to and from the intermediate transfer belt 6 is provided.

The secondary transfer outer roller 11 includes a stainless-steel shaft 12 mm in diameter and a conductive urethane sponge layer 6 mm in thickness. The length of the sponge portion is 330 mm. The resistance value is obtained from the relationship of current measured when the shaft is grounded under a load of 500 gram-weight, the transfer roller is rotated at a peripheral speed of 300 mm/s, and a voltage of 3000 V is applied to the surface of the transfer roller. The value was about $6\times10^7\Omega$ (23° C. 50% RH).

In this embodiment, the secondary transfer section uses constant voltage control in which a set voltage is applied constantly.

The reason is that the secondary transfer section needs to perform sufficient transfer onto various sizes and types of recording materials, and the shared voltage of paper needs to be taken into consideration when the applied transfer voltage is determined.

Therefore, the secondary transfer section needs to perform ATVC (Active Transfer Voltage Control) to determine the applied voltage.

The ATVC control in this embodiment is performed during the rotation before image formation. Three different biases are applied, and current values are detected. From the results, a voltage value with respect to the target current is calculated. The calculated voltage is applied during image formation.

The voltage actually applied to the secondary transfer section is determined from the result of the previous ATVC control and a paper shared-voltage table prepared in the apparatus.

Thus, on the basis of the result of the previous control, a positive voltage is applied to the secondary transfer outer roller 11 by the power source 400. Thus, a transfer charge determined from the surface potential of the transfer roller is charged, and the toner image t on the intermediate transfer belt 6 is transferred to the surface of a recording material P.

A belt cleaning unit 12 includes a cleaner blade 12*a*. The cleaner blade 12*a* is in contact with the intermediate transfer belt 6 at a predetermined angle and a predetermined pressure, and recovers toner and so forth remaining on the surface of the intermediate transfer belt 6.

The recording material P to which the toner image t is transferred is introduced into a fixing unit 13 and is heated and pressed. Thus, the toner image t is fixed to the surface of the recording material P.

(2) Description of Density Detecting Sensor

In the above-described image forming apparatus, as images are output, toner in the developing units 4Y, 4M, 4C, and 4K is consumed, and the image density decreases.

A density detecting sensor 5 is provided between the developing section 4 and the primary transfer section in the rotating direction of the photosensitive drum 1. The density detecting sensor 5 is a toner image detecting unit that irradiates the surface of the photosensitive drum with light and, from the reflected light, detects the toner density on the surface of the photosensitive drum.

The density detecting sensor 5 includes an infrared light emitting unit and a light receiving unit. In this embodiment, near-infrared light having a center wavelength of 950 nm is used as a light source of the density detecting sensor 5. The photosensitive drum 1 reflects the near-infrared light, whereas the toner used is of a type that absorbs the near-infrared light.

The density detecting sensor 5 measures the quantity of reflected light when the toner image on the photosensitive drum 1 faces the density detecting sensor 5.

If it is determined that the quantity of reflected light is larger than a threshold, that is, the toner image density is low, adjustment of image forming condition, such as adjustment of developing bias or supply of toner, is performed.

Figure 2:
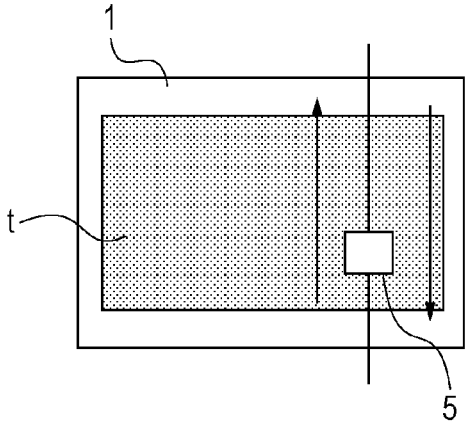
FIG. 2 is a schematic view of the operation of a density detecting sensor in the present invention.

In this embodiment, as shown in FIG. 2, the density detecting sensor 5 is moved relative to the photosensitive drum 1, by a drive unit (not shown), in the main scanning direction. This embodiment needs a sensor or sensors that perform control of density on the photosensitive drum (adjustment of the developing unit) and vertical line discrimination. Using different sensors for different uses makes the apparatus large and complex. Therefore, in this embodiment, the above-described sensor is used. Of course, instead, infrared light emitting units and light receiving units may be arranged in the main scanning direction.

A line sensor including a plurality of light receiving elements may be used.

(3) Method for Discriminating Vertical Line

In this embodiment, a description will be given of a vertical line detecting processing operation using the above-described density detecting sensor 5. This vertical line detecting processing operation is performed when an image is not being formed.

Figure 3:
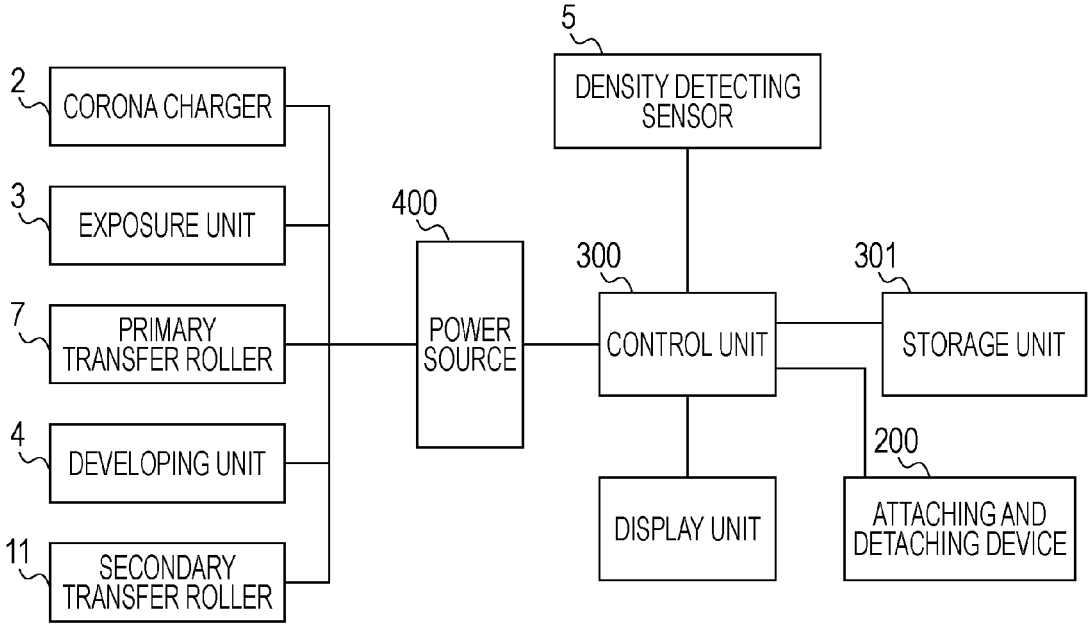
FIG. 3 is a block diagram in the first embodiment.

FIG. 3 is a block diagram of this embodiment. The control unit 300 is a CPU. On the basis of information stored in the storage unit 301, the image forming apparatus can be controlled. The density information read by the density detecting sensor 5 is input into the control unit. The control unit 300 controls the power source 400, and controls the operations of the primary charger 2, the exposure unit 3, the primary transfer roller 7, the developing unit 4, and the secondary transfer roller 11. The control unit 300 outputs the state of the belt member on the basis of the result of detection by the density detecting sensor, of a toner image formed by the developing unit in a charged region of the photosensitive drum charged by the primary transfer member. The control unit outputs information to the display unit that displays information.

Figure 4:
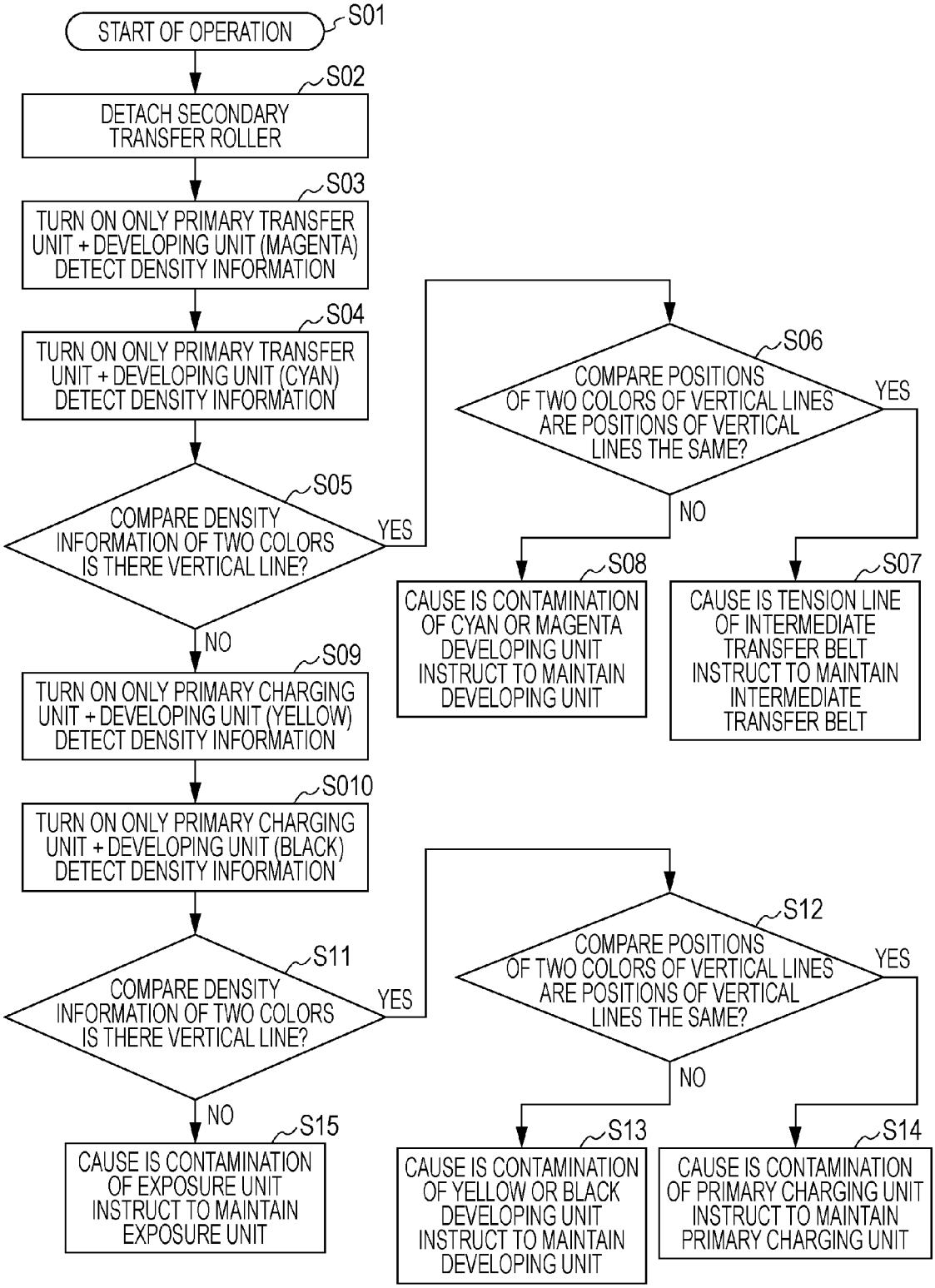
FIG. 4 is a flowchart of an operation to identify the cause of a vertical line in the first embodiment.

FIG. 4 is a flowchart showing the vertical line detecting processing operation in this embodiment.

The operation shown in FIG. 4 is performed by order of the user when the user finds a vertical line generated in a toner image on paper. Specifically, the user selects a vertical line detecting processing mode from an operation unit (display unit) for displaying information and operational inputting.

First, during the vertical line detecting operation, the secondary transfer roller 11 is detached from the intermediate transfer belt 6, and a formed toner image is removed by the transfer belt cleaning unit 12.

Since a toner image formed on the photosensitive drum 1 is not fully transferred onto the photosensitive drum 1, residual toner is removed by the photosensitive drum cleaning unit 8.

To detect the position and level of the vertical line, in this embodiment, first, the bias application to the primary transfer roller 7 and the bias application to the developing sleeve of the developing unit 4 are turned on. Then, the bias application to the pre-exposure unit 9, the exposure unit 3, and the primary charger 2 is turned off (stopped). Toner images formed in this operation are one-colored. At least two colors of one-colored even images are formed.

To detect the position of the vertical line in the main scanning direction, toner images formed in this operation need to be full-surface images.

Next, in this embodiment, the bias application to the primary charger 2 and the bias application to the developing sleeve 41 of the developing unit 4 are turned on. The bias application to the primary transfer roller 7, and the exposure unit 3 are turned off, a toner image is formed on the photosensitive drum 1, and the position of the vertical line is detected. It makes no difference if the pre-exposure unit 9 is turned on or off.

The reason of these operations will be described. If a vertical line is generated on paper in this embodiment, possible factors include contamination of the primary charging wire, contamination of the exposure unit (dust-proof glass), contamination of each color of developing roller, a tension line of the intermediate transfer belt, and defective cleaning.

As described above, a vertical line due to defective cleaning is generated regardless of whether image part or non-image part, and is therefore easily discriminated.

Vertical lines due to contamination of a developing roller are likely to be generated at different locations depending on color.

In a system that forms a toner image on an image bearing member and determines that a tension line is generated in an intermediate transfer belt from the unevenness in density of the toner image as in this embodiment, it is necessary to determine whether the vertical line is attributed to development or a tension line.

The reason why two or more one-colored toner images are formed in each operation (by the primary transfer section and the developing section only) is that the cause can be identified from the positions of vertical lines. If the cause is contamination of developing rollers, vertical lines are generated at different locations depending on color. If the cause is a tension line in the intermediate transfer belt, vertical lines are generated at the same position regardless of color.

Next, the bias to the primary charger 2 and the bias to the developing sleeves of the developing unit 4 are turned on, the primary transfer roller 7 and the exposure unit 3 are turned off, and the positions of vertical lines generated in toner images formed on the photosensitive drum 1. The reason is that if contamination of the primary charging wire or contamination of the exposure unit (dust-proof glass) causes the vertical line, vertical lines are generated at the same position regardless of color.

When the vertical line is attributed to neither the intermediate transfer belt or the developing unit, it cannot be determined whether the vertical line is attributed to the primary charger or the exposure unit.

In an image forming apparatus such as that of this embodiment, a photosensitive drum, a primary charger, and an exposure unit are common to four colors of toners, and a color image is formed using four colors of developing units. So, toner images are formed using the primary charger and the exposure unit, the positions of the vertical lines in the toner images are detected, and the contamination of the primary charger and the contamination of the exposure unit are discriminated.

The vertical line detecting operation in this embodiment will be described in detail with reference to the flowchart of FIG. 4.

First, by order of the user (S01), the image forming apparatus starts the vertical line detecting operation. The attaching and detaching device 200 for attaching and detaching the secondary transfer roller to and from the intermediate transfer belt detaches the secondary transfer roller 11 from the intermediate transfer belt (S02).

Next, the bias to the primary transfer roller and the developing sleeve of the developing unit is turned on, a toner image t is formed on the photosensitive drum 1, and the density detecting sensor 5 detects the density information of the toner image t (S03). At this time, the pre-exposure unit 9, the primary charger, and the exposure unit are turned off.

A vertical line appears the most noticeably in the case of a halftone image. Therefore, the primary transfer bias and the developing bias are controlled so that the toner image t is a halftone image. The image pattern in this operation needs to have uniform image density in the main scanning direction.

Figure 6:
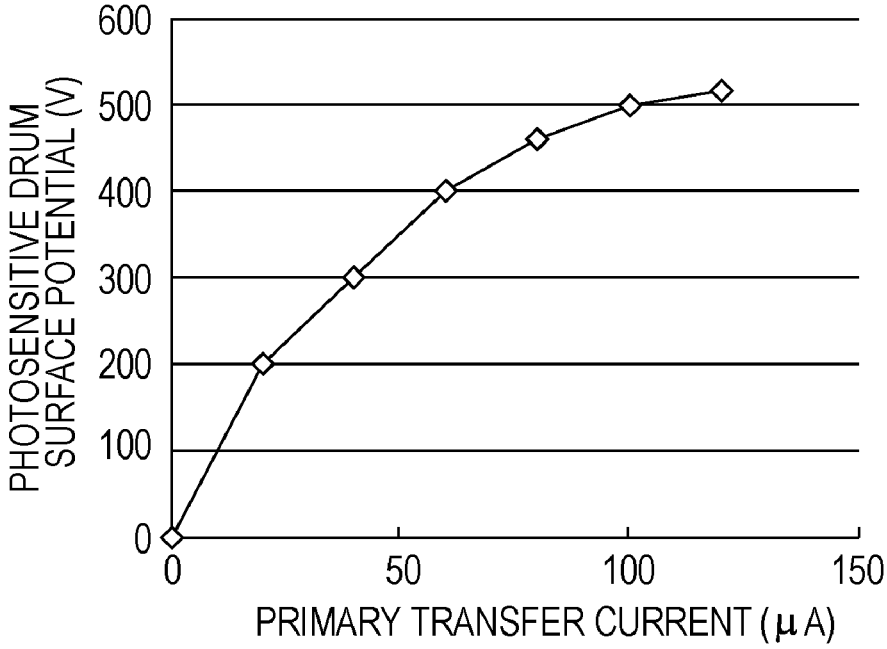
FIG. 6 shows the relationship between the primary transfer current and the surface potential of a photosensitive drum after primary transfer in the first embodiment.

In this operation, an electrostatic latent image is formed using the primary transfer roller 7. In this embodiment, the condition of the bias applied to the primary transfer roller 7 is controlled according to the relationship between primary transfer current and photosensitive drum potential shown in FIG. 6.

In the primary transfer roller 7, the polarity of a bias to be applied is selected according to the polarity of the photosensitive drum 1. Since the photosensitive drum is charged positively in this embodiment, a positive bias is applied. Of course, when a photosensitive drum that is charged negatively is used, a negative bias is applied to the primary transfer roller 7. That is, the polarity of the bias applied to the primary transfer roller 7 at this time is the same as the polarity of the bias of the primary charger during image formation.

In normal image formation, the electrostatic latent image potential is controlled by the primary charger so that the surface potential of the photosensitive drum 1 is +500 V. Therefore, during this operation, the primary transfer current was set to 100 μA so that the photosensitive drum potential after primary transfer is +500 V. The developing bias was set to +400 V.

As described above, the density detecting sensor 5 can be moved by a drive unit (not shown) in the main scanning direction and can therefore detect the unevenness in density or a vertical line at each position in the main scanning direction.

Figure 5:
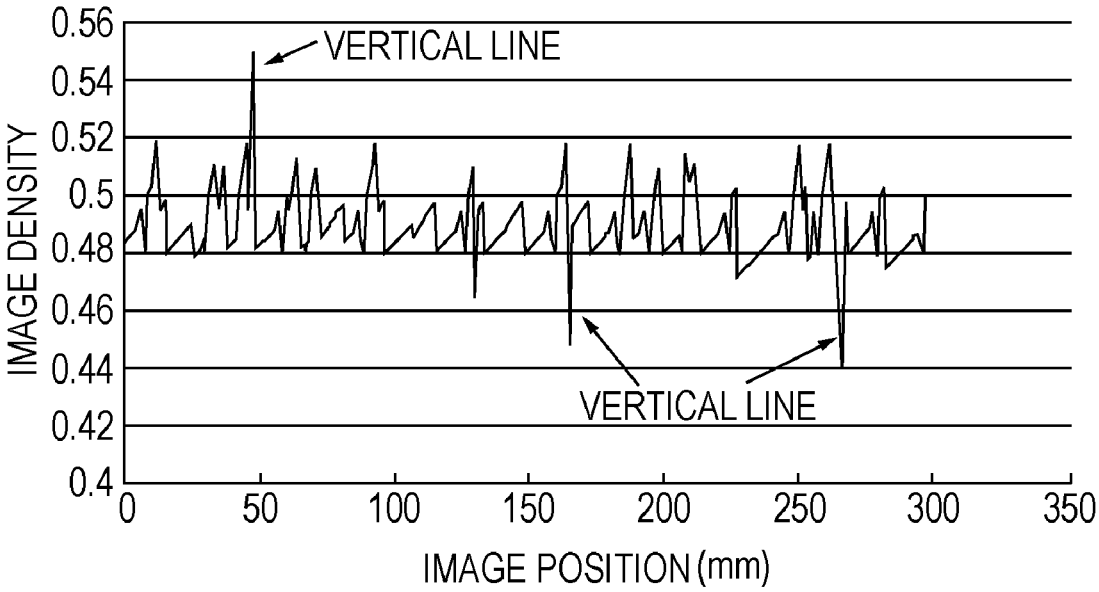
FIG. 5 shows an example of the result of image density examination by an image density detecting sensor in the main scanning direction.

The density information in the main scanning direction obtained in the step S03 is stored in the storage unit 301. The density information at each position is stored in the storage unit 301 as shown in FIG. 5. A position where the density difference is ±0.02 or more is identified as a vertical line, and the vertical line position is stored.

Next, a cyan toner image is formed, and the density detecting sensor 5 detects the density of the toner image (S04). The condition of the bias applied to the primary transfer section and the developing sleeve of the developing unit 4 is the same as the condition in the case of magenta. The photosensitive drum 1 was charged to +500V, and the developing bias was set to +400 V. Under this bias condition, a cyan toner image similar to the magenta toner image is formed on the photosensitive drum 1, and the density detecting sensor 5 detects the image density information in the main scanning direction. The density information in the main scanning direction obtained in this step is stored in the storage unit 301.

The density information in the main scanning direction of the magenta image is compared with the density information of the cyan image (S05). It is determined whether or not there is a vertical line in at least one of the images. If there is a vertical line in at least one of the images, step S06 is proceeded to. If there is a vertical line in neither image, step S09 is proceeded to.

If the vertical line detected in the magenta image and the vertical line detected in the cyan image are the same in location, the vertical line is attributed to a tension line in the intermediate transfer belt (S06). In this case, a message saying "Replace belt" is displayed on the screen of the operation unit (S07). If the vertical line detected in the magenta image and the vertical line detected in the cyan image are different in location, the cause is contamination of the developing sleeve of the developing unit (S08).

If no vertical line is detected in this operation, the cause is contamination of the primary charger 2, contamination of the yellow or black developing roller, or contamination of the exposure unit 3.

To determine whether the cause is contamination of the primary charger 2, a toner image t is formed on the photosensitive drum 1 using only the primary charger 2 and the yellow developing unit 4C (S09).

Of course, to check for contamination of the yellow and black developing sleeves at the same time, developing colors used in this operation are yellow and black (S09, S10).

In this embodiment, the photosensitive drum 1 was charged to +500 V using the primary charger 2.

As in the previous operation, to form a halftone image, the bias of the developing unit was set to +400 V. Under such a bias setting, yellow and black one-color images are formed on the photosensitive drum 1, and the density detecting sensor 5 detects the density unevenness in the main scanning direction.

Then, the density information in the main scanning direction of the two colors are compared (S11). If the locations of vertical lines in the two colors of images are the same, the vertical line can be attributed to the primary charger (S12, S14). If the locations of vertical lines in the two colors of images are different, the vertical line can be attributed to contamination of the yellow or black developing sleeve (S13). If the cause is identified, a message that directs the user to perform maintenance is displayed on the display unit that displays information.

By the above two operations, the vertical line can be attributed to contamination of the primary charging section, a tension line in the intermediate transfer belt 6, or contamination of the developing roller.

If no vertical line is detected in the above two operations, the cause is contamination of the exposure unit 3 (S15).

As described above, by forming toner images on the image bearing member using the transfer section and the developing section, detecting the vertical line positions, and comparing at least two colors of toner images, the level of the tension line generated in the intermediate transfer belt can be easily determined.

Similarly, by comparing toner images formed using the primary charger and the developing section, the component causing the vertical line can be identified more accurately. This information is displayed on the display unit that displays information, and thereby the user is accurately directed to perform maintenance.

That is, by this embodiment, it is easily determined whether a belt member is damaged.

Second Embodiment

Figure 7:
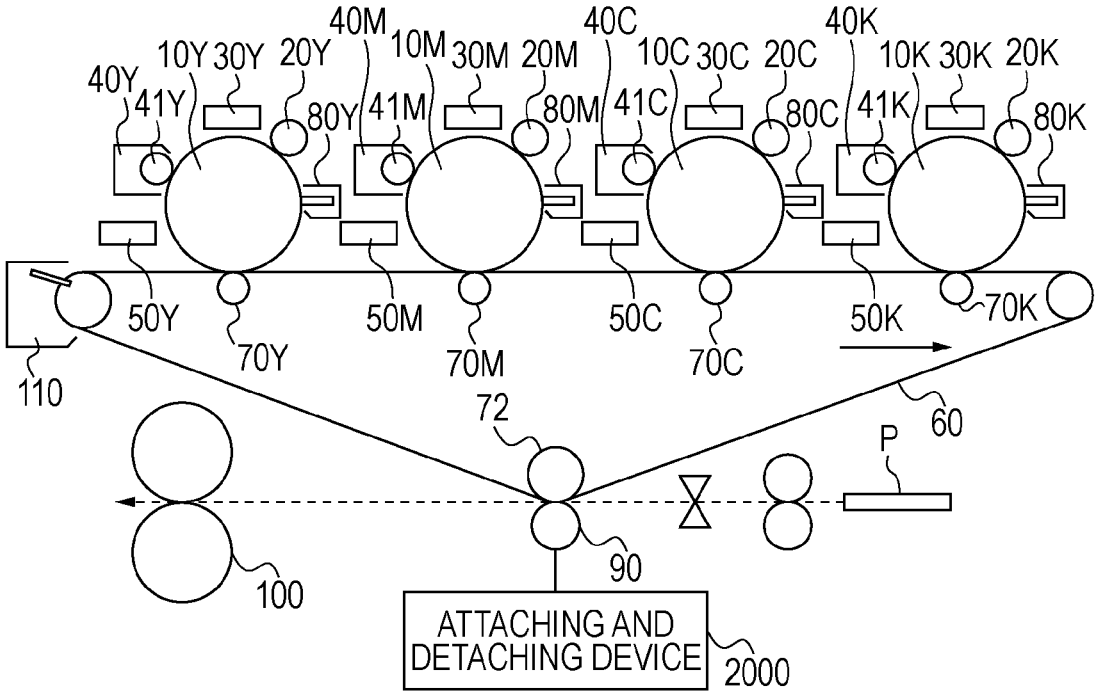
FIG. 7 is a schematic view of an image forming apparatus in a second embodiment.

In this embodiment, a description will be given of identification of the cause of a vertical line in a tandem-type image forming apparatus in which four colors of (yellow (Y), magenta (M), cyan (C), and black (K)) image forming sections are arranged in a line as shown in FIG. 7.

In the image forming apparatus shown in FIG. 7, reference numerals 10Y, 10M, 10C, and 10K denote photosensitive drums that form an electrostatic latent image. Reference numerals 20Y, 20M, 20C, and 20K denote charging units. Reference numerals 30Y, 30M, 30C, and 30K denote exposure units. Reference numerals 40Y, 40M, 40C, and 40K denote developing units. Reference numerals 50Y, 50M, 50C, and 50K denote image density sensors that detect the image density on the photosensitive drums. The density sensors are movable in the main scanning direction. Reference numeral 60 denotes an intermediate transfer belt. Reference numerals 70Y, 70M, 70C, and 70K denote primary transfer rollers that transfer toner images formed on their corresponding photosensitive drums onto the intermediate transfer belt 60. The primary transfer rollers 70Y to 70K are the same as the primary transfer roller used in the first embodiment. Image forming units serving as image forming sections each include a photosensitive drum, a charging unit, an exposure unit, and a cleaning unit.

In each image forming unit, in primary charging units 2Y to 2K, the photosensitive drums 10Y to 10K are each charged to −600 V. After that, exposure according to an image signal is performed by the exposure units 30Y to 30K, and thereby electrostatic latent images are formed on the photosensitive drums 1Y to 1K. After that, in the developing units 40Y to 40K, a toner image is developed on each photosensitive drum. In this embodiment, the developing units 40Y to 40K each contains two-component developer, and a toner image is formed on each photosensitive drum. The developing units have developing sleeves 410Y to 410K for developing.

In this embodiment, a developing bias having a DC component variable within a range of −150 to −400 V is applied to the developing sleeves 410Y to 410K, and thereby development is performed.

A primary transfer bias is applied to the primary transfer rollers 70Y to 70K, and thereby the toner images formed on the photosensitive drums 10Y to 10K are transferred onto the intermediate transfer member.

In this embodiment, constant current control is performed so that about +30 μA of current flows through the primary transfer rollers.

The primary transfer current source in this embodiment is a power source capable of outputting both positive and negative current.

After primary transfer, residual toner on the photosensitive drums is removed by photosensitive drum cleaning units 80Y to 80K.

The toner images transferred onto the intermediate transfer belt 60 are secondarily transferred onto a recording material by a secondary transfer roller 90 that forms a secondary transfer section T2. The secondary transfer roller 90 used in this embodiment can be attached to and detached from the intermediate transfer belt 60 by an attaching and detaching device 2000. The attaching and detaching device 2000 is the same as the attaching and detaching device 200 used in the first embodiment.

The toner images transferred to the recording material in the secondary transfer section T2 are fixed by a fixing unit 100. Thus, a full color image is obtained. Residual toner on the intermediate transfer belt 60 is removed by a transfer belt cleaning unit 110.

In the above image forming apparatus that has a plurality of image forming units, a vertical line image is attributed to the primary charging sections, the exposure units, the developing units, or a tension line of the intermediate transfer belt.

Also in such a image forming apparatus, the cause of a vertical line can be identified by an operation such as that in the first embodiment.

However, this embodiment differs from the first embodiment in that when the locations of vertical lines detected in the respective image forming units are the same, the vertical line can be attributed to a tension line of the intermediate transfer belt.

Figure 8:
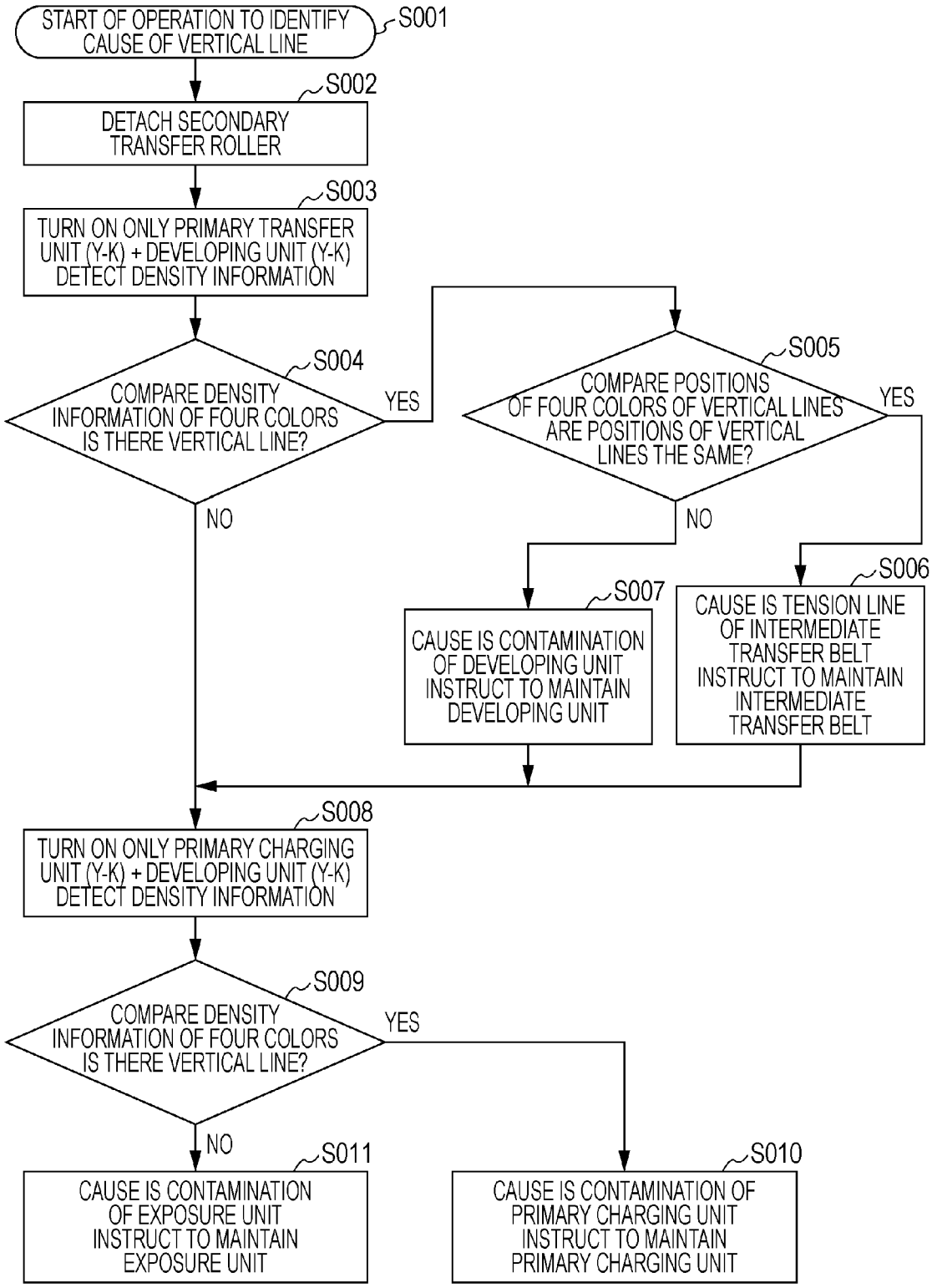
FIG. 8 is a flowchart of an operation to identify the cause of a vertical line in the second embodiment.

The reason is that, unlike the first embodiment, a primary charging unit exists in each image forming unit. Therefore, in this embodiment, as shown in FIG. 8, it can be determined whether the vertical line is attributed to a tension line of the intermediate transfer belt just by performing image formation using only the primary transfer sections and the developing sections.

In this embodiment, density information is input into the control unit from the density detecting sensors 50Y to 50K. The control unit controls the image forming apparatus on the basis of the information stored in the storage unit. The control unit outputs a secondary transfer roller attaching/detaching signal to the attaching and detaching device 2000. The control unit controls the voltages output to the charging units, the exposure units, the primary transfer rollers, the developing units, and the secondary transfer roller. The control unit outputs the state of the belt member on the basis of the result of detection by the density detecting sensors, of toner images formed by the developing units in charged regions of the photosensitive drums charged by the primary transfer members. The control unit outputs information to the display unit that displays information.

An operation to identify the cause of a vertical line in this embodiment will be described with reference to FIG. 8.

The user directs to perform the operation to identify the cause of a vertical line (S001). The attaching and detaching device 2000 detaches the secondary transfer roller from the intermediate transfer member (S002).

Next, the bias application to the primary transfer rollers 70Y to 70K in the image forming sections and the bias application to the developing sleeves 410Y to 410K are turned on, and toner images are formed on the photosensitive drums 10Y to 10K of the respective image forming units (S003). At this time, the primary chargers, the exposure units, and the pre-exposure units are turned off.

Figure 9:
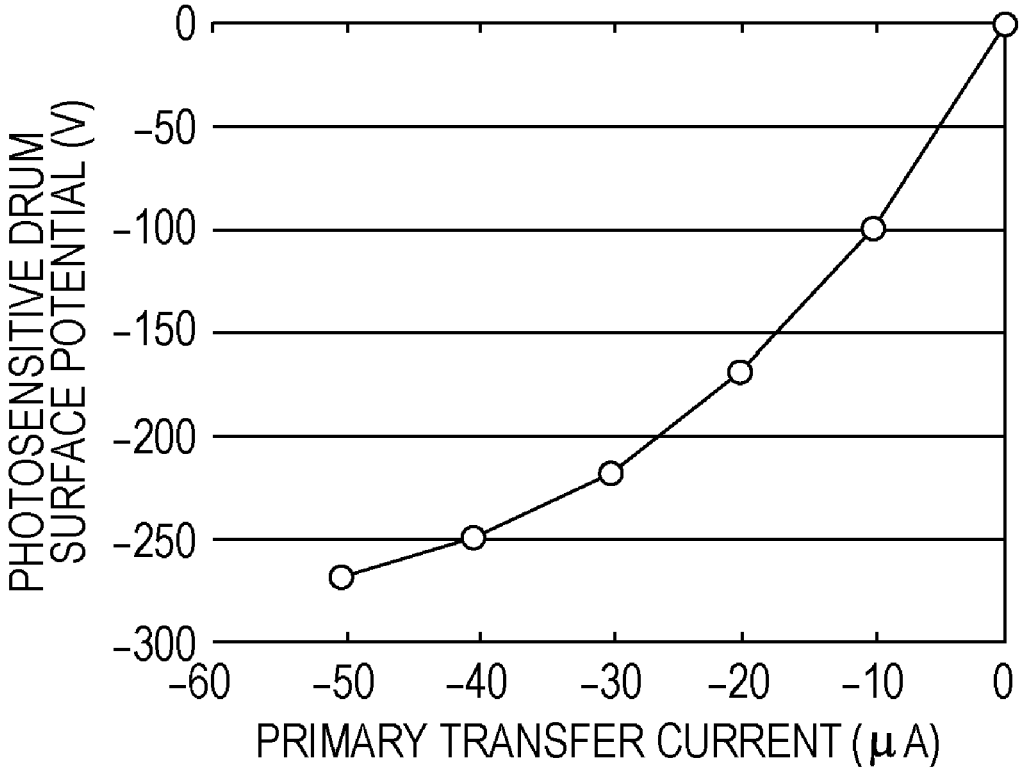
FIG. 9 shows the relationship between the primary transfer current and the surface potential of a photosensitive drum after primary transfer in the second embodiment.

Also in this embodiment, the density information in the main scanning direction is detected in a halftone image. In normal image formation, the surface potential of the exposed photosensitive drum when a solid image is formed was −200 V. Therefore, the primary transfer current was set from the relationship between primary transfer current and photosensitive drum potential after primary transfer of FIG. 9 so that the photosensitive drum potential after primary transfer is −200 V, and a developing bias was set so that a halftone image is formed. A voltage having a polarity opposite to the polarity of the bias applied during image formation is applied to the primary transfer rollers 70.

As a result, the primary transfer current was set to −25 μA, and the developing bias was set to −300 V.

Under such a bias setting, a toner image is formed on each photosensitive drum. The result of density detection in the main scanning direction by the density detecting sensors 50Y to 50K is sent to the control unit, and the locations of vertical lines are compared (S004).

If the locations of respective colors of vertical lines detected are the same, the vertical line is attributed to a tension line of the intermediate transfer belt (S005). If not, the vertical line is attributed to contamination of the developing units (S007). In each case, if the cause is identified, a message that directs the user to perform maintenance is displayed on the display unit that displays information (S006, S007).

Next, in each image forming unit, a bias is applied to the primary charger and the developing sleeve of the developing unit, a toner image is formed on the photosensitive drum, and the image density thereof is detected (S008).

In this embodiment, the primary charging bias is controlled so that the surface potential of each photosensitive drum after primary transfer is −200 V, and the developing units are set to −300 V as in the previous step.

If a vertical line is detected in this operation, the vertical line can be attributed to contamination of the primary chargers (S009, S010).

The reason is that the locations of vertical lines generated in the developing units are already known from the result of the previous density detection using the primary charging units and the developing units.

If no vertical line is detected in this operation, the vertical line can be attributed to the exposure units (S011).

As described above, also in an image forming apparatus including a plurality of image forming units such as this embodiment, it can be easily determined whether a vertical line is attributed to a tension line of the intermediate transfer belt.

Third Embodiment

Next, another embodiment of the present invention will be described. In the first and second embodiments, one or more density detecting sensors serving as toner detecting units are provided. In this embodiment, a potential detecting unit is provided that detects the surface potential of the image bearing member. In this embodiment, it is identified what is wrong using a potential sensor serving as a potential detecting unit.

Figure 10:
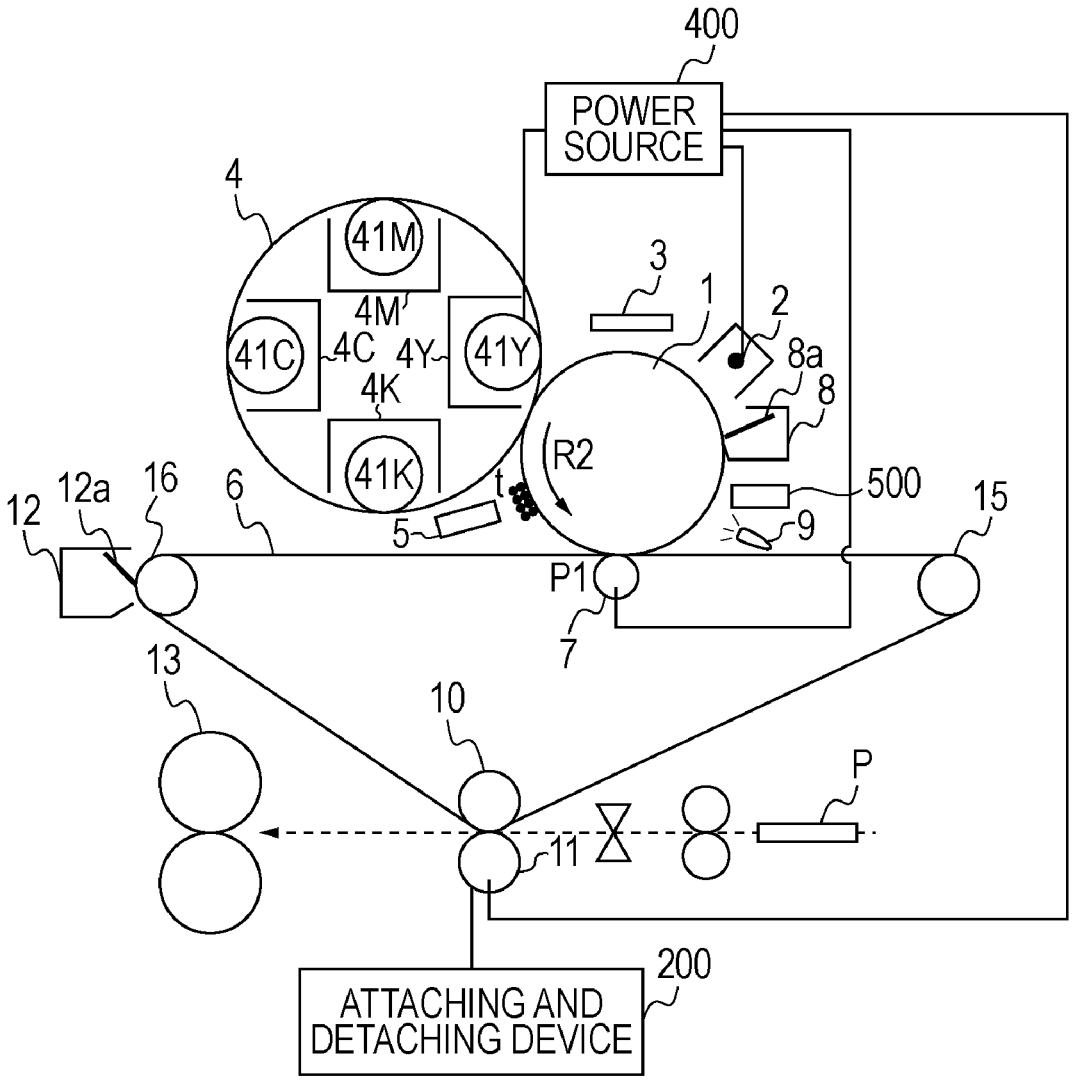
FIG. 10 is a schematic view of an image forming apparatus in a third embodiment.

FIG. 10 shows an image forming apparatus according to this embodiment. In addition to a density detecting sensor, a potential sensor 500 is provided. Other components are the same as those in the first embodiment, and therefore redundant description will be omitted.

In this embodiment, the potential sensor 500 is disposed downstream of the transfer section P1 and upstream of the cleaning unit 8 in the rotating direction of the photosensitive drum 1. The potential sensor 500 may be disposed at another position.

The potential sensor and the control unit 300 of this embodiment are capable of transmitting and receiving data (signals).

The potential sensor 500 can be moved relative to the photosensitive drum by a drive unit (not shown) in the main scanning direction. A line sensor including a plurality of potential detecting elements may be used as the potential sensor 500.

In this embodiment, the bias to the primary charger 2, the exposure unit 3, and the developing sleeve 41 of the developing unit 4 are turned off, a voltage is applied to the transfer member 7, the unevenness in potential of the image bearing member in the main scanning direction is detected, and thereby it is determined whether or not there is a tension line in the belt member. In this embodiment, if there is a part about 10 V higher or lower in potential, the part is attributed to a tension line.

Figure 11:
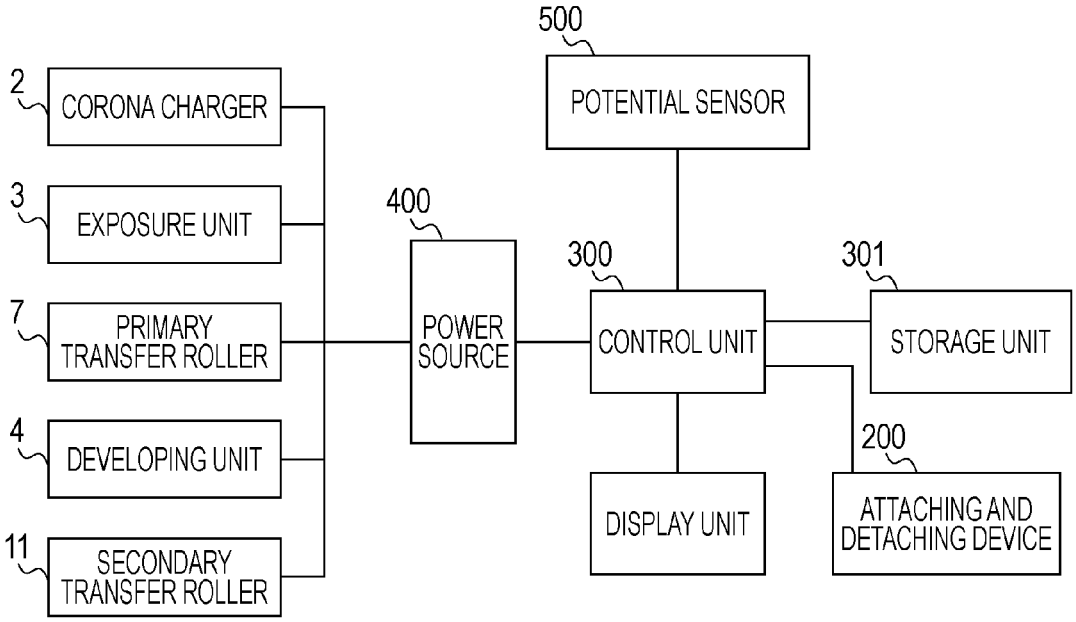
FIG. 11 is a block diagram in the third embodiment.

FIG. 11 shows a block diagram of this embodiment. The control unit 300 is a CPU. On the basis of information stored in the storage unit 301, the image forming apparatus can be controlled. The density information read by the density detecting sensor 500 is input into the control unit. The control unit 300 controls the power source 400, and controls the operations of the primary charger 2, the exposure unit 3, the primary transfer roller 7, the developing unit 4, and the secondary transfer roller 11. The control unit 300 outputs the state of the belt member on the basis of the result of detection by the potential sensor 500, of the surface of the photosensitive drum charged by the primary transfer roller to which a voltage is applied. The control unit outputs information to the display unit that displays information.

Figure 12:
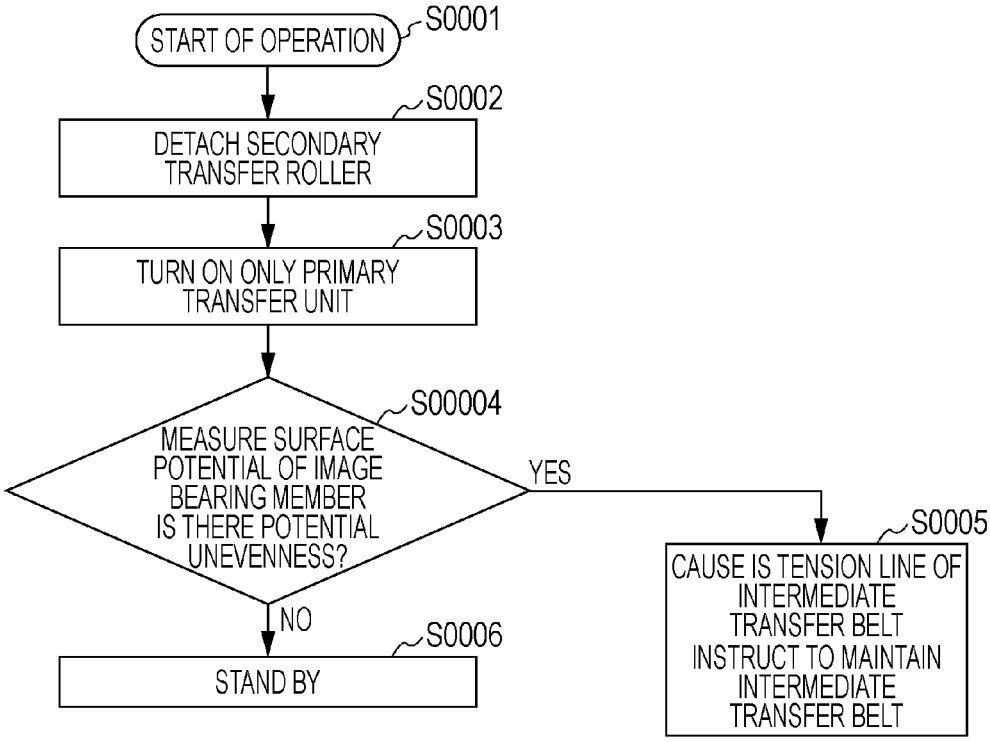
FIG. 12 is a flowchart of an operation to detect a line in a belt in the third embodiment.

Next, the flowchart of this embodiment will be described with reference to FIG. 12.

The user directs to perform the belt line detecting operation (S0001). As in the first embodiment, the secondary transfer roller is detached from the intermediate transfer member (S0002).

Next, a bias is applied to the primary transfer roller of the image forming section, and the photosensitive drum 1 is charged (S0003).

In this embodiment, the potential information in the main scanning direction is detected in a halftone image. In normal image formation, the surface potential of the exposed photosensitive drum 1 when a solid image is formed was +500 V. Therefore, the primary transfer current was set from the relationship between primary transfer current and photosensitive drum potential after primary transfer of FIG. 5 so that the photosensitive drum potential after primary transfer is +500 V.

As a result, the primary transfer current was set to 100 μA.

Under such a bias setting, the photosensitive drum 1 is charged by the primary transfer roller 7. At that time, the bias to the primary charger 2, the bias to the developing sleeve of the developing unit 4, the exposure unit 3, and the pre-exposure unit 39 are all turned off (S0003). Then, the potential sensor 500 detects the charged surface in the main scanning direction (S0004). The detected potential in the main scanning direction is stored in the storage unit 301, and it is determined whether or not there is a part 10 V higher or lower in potential in the stored potential distribution in the main scanning direction (S0004).

If there is a part 10 V or more higher or lower in potential, a message saying "Maintain intermediate transfer belt 6" is displayed on the display unit (S0005).

If there is no part 10 V or more higher or lower in potential, the intermediate transfer belt 6 is determined to be normal, and the apparatus enters a standby mode in which the apparatus waits for an image forming signal.

As described above, also by detecting the surface potential of the image bearing member, it can be easily determined whether the belt member is damaged.

In the above embodiments, an intermediate transfer belt is used as a belt member. However, the same advantageous effect can be obtained by making a belt member (a transfer belt) bear a recording material thereon and forming a toner image on the recording material.

In the above embodiments, when the primary transfer roller charges the photosensitive drum, the voltage to the charging member is turned off. However, a voltage may be applied that is lower than the voltage during image formation and does not affect the charging characteristic of the primary transfer roller.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-264344 filed Oct. 10, 2008, which is hereby incorporated by reference herein in its entirety.

What is claimed is:

1. An image forming apparatus comprising:

an image bearing member;

a charging unit that charges the image bearing member;

a developing unit that develops an electrostatic latent image formed by exposing a surface charged by the charging unit and forms a toner image;

a toner image detecting unit that detects the toner image on the image bearing member;

a belt member in contact with the image bearing member;

a transfer member for transferring the toner image on the image bearing member onto the belt member or onto a recording material on the belt member; and a control unit capable of outputting a state of the belt member on the basis of the result of detection by the toner image detecting unit, of a toner image formed by charging the image bearing member by applying a voltage to the transfer member, and developing a region charged by the transfer member using the developing unit.

2. The image forming apparatus according to claim 1, wherein when the transfer member to which a voltage is applied charges the image bearing member and the developing unit develops a region charged by the transfer member, application of a voltage to the charging unit is stopped.

3. The image forming apparatus according to claim 1, wherein the image forming apparatus has different colors of developing units, and at least two one-color images are formed on the image bearing member by the transfer member and at least two developing units.

4. The image forming apparatus according to claim 1, wherein a voltage of the same polarity as the charging polarity of the image bearing member is applied to the transfer member that forms an electrostatic latent image on the image bearing member.

5. An image forming apparatus comprising:

an image bearing member;

a charging unit that charges the image bearing member;

a developing unit that develops an electrostatic latent image formed by exposing a surface charged by the charging unit;

a belt member in contact with the image bearing member;

a transfer member for transferring the toner image on the image bearing member onto the belt member or onto a recording material on the belt member;

a potential detecting unit that detects the surface potential of the image bearing member; and a control unit capable of outputting the state of the belt member on the basis of the result of detection of the surface potential of a region charged by the transfer member to which a voltage is applied.

6. The image forming apparatus according to claim 5, wherein when the transfer member to which a voltage is applied charges the image bearing member, application of a voltage to the charging unit is stopped.

7. The image forming apparatus according to claim 5, wherein the polarity of the voltage applied to the transfer member when the control unit is executed is opposite to the polarity of a voltage applied to the transfer member to transfer a toner image to the belt member.

* * * * *